US009441590B2

(12) United States Patent
Christ et al.

(10) Patent No.: US 9,441,590 B2
(45) Date of Patent: Sep. 13, 2016

(54) FUEL INJECTION VALVE

(75) Inventors: Wilhelm Christ, Ludwigsburg (DE); Gerhard Suenderhauf, Tiefenbronn (DE); Michael Leukart, Stuttgart (DE); Katja Grothe, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 819 days.

(21) Appl. No.: 13/392,914

(22) PCT Filed: Jul. 19, 2010

(86) PCT No.: PCT/EP2010/060415

§ 371 (c)(1),
(2), (4) Date: Feb. 28, 2012

(87) PCT Pub. No.: WO2011/023467

PCT Pub. Date: Mar. 3, 2011

(65) Prior Publication Data

US 2012/0153053 A1 Jun. 21, 2012

(30) Foreign Application Priority Data

Aug. 28, 2009 (DE) ..... 10 2009 028 960
Sep. 17, 2009 (DE) ..... 10 2009 029 542

(51) Int. Cl.
*F02M 61/10* (2006.01)
*F02M 61/12* (2006.01)
*F02M 61/18* (2006.01)

(52) U.S. Cl.
CPC ..... *F02M 61/10* (2013.01); *F02M 61/12* (2013.01); *F02M 61/18* (2013.01); *F02M 61/1886* (2013.01)

(58) Field of Classification Search
CPC ..... F02M 61/10; F02M 61/12; F02M 61/18; F02M 61/1886
USPC ..... 239/533.3, 533.11, 533.12
See application file for complete search history.

(56) References Cited

U.S. PATENT DOCUMENTS 2,822,789 A 2/1958 Philips et al.
2,927,737 A * 3/1960 Werner ..... 239/533.3

(Continued)

FOREIGN PATENT DOCUMENTS

| | | |
|---|---|---|
| CN | 1187233 | 7/1998 |
| CN | 1383471 | 12/2002 |
| CN | 1755098 | 4/2006 |
| DE | 10111035 | 10/2001 |
| DE | 102004047183 | 3/2006 |
| DE | 202006007883 | 10/2006 |

(Continued)

OTHER PUBLICATIONS

PCT/EP2010/060415 International Search Report dated Oct. 21, 2010 (3 pages).

*Primary Examiner* — Justin Jonaitis
(74) *Attorney, Agent, or Firm* — Michael Best & Friedrich LLP

(57) ABSTRACT

The invention relates to a fuel injection valve for injecting fuel into a combustion chamber of an internal combustion engine, having a nozzle needle (1) which is guided, such that it can perform a stroke movement, in a central bore (2) of a nozzle body (3) in order to open up or close off at least one injection opening (4), wherein the nozzle needle (1) interacts, by means of an encircling sealing region (5) formed on the combustion-chamber-side end thereof, with a sealing seat (6) that runs conically and is formed on the combustion-chamber-side end of the nozzle body (3). According to the invention, the sealing seat (6) that runs conically has an opening angle ($\alpha_1$) of between 30° and 50°, preferably of between 40° and 50°.

3 Claims, 2 Drawing Sheets

(56) References Cited

U.S. PATENT DOCUMENTS

| | | | | |
|---|---|---|---|---|
| RE35,101 | E * | 11/1995 | Kelly | 123/467 |
| 5,890,660 | A * | 4/1999 | Stevens | 239/533.3 |
| 6,257,506 | B1 * | 7/2001 | Hofmann et al. | 239/533.2 |
| 6,546,914 | B1 * | 4/2003 | Fath et al. | 123/467 |
| 7,000,856 | B2 * | 2/2006 | Mattes | F02M 61/1873 123/467 |
| 2005/0028365 | A1 | 2/2005 | Dantes | |

FOREIGN PATENT DOCUMENTS

| | | |
|---|---|---|
| DE | 102006012242 | 9/2007 |
| EP | 0460326 | 12/1991 |
| RU | 2175078 | 10/2001 |
| RU | 2002116253 | 2/2005 |
| WO | 2004/104408 | 12/2004 |
| WO | 2007/104590 | 9/2007 |

* cited by examiner

FUEL INJECTION VALVE

BACKGROUND OF THE INVENTION

The invention relates to a fuel injection valve for injecting fuel into a combustion chamber of an internal combustion engine.

German Laid-Open Application DE 10 2006 012 242 A1 has disclosed a fuel injection valve for an internal combustion engine, which has a valve body, in which there is formed a pressure space which can be filled with fuel at high pressure and from which at least one injection opening starts. Arranged in the pressure space is a longitudinally movable valve needle, which interacts by means of a sealing surface with a conical valve seat formed in the pressure space in order to open and close the at least one injection opening. To ensure that sufficient fuel flows between the sealing surface of the valve needle and the valve seat to the injection openings to achieve an appropriate injection rate, the valve needle must traverse a certain minimum stroke. This is because it is first necessary to cross the region in which the gap between the sealing surface and the valve seat exerts a restricting effect and the injection pressure prevailing at the injection openings is reduced. With a large minimum stroke for achieving the full injection pressure, however, it is not possible to achieve a rapid succession of injections. In the laid-open application mentioned above, therefore, a conically formed valve seat with an opening angle of between 75° and 100° is proposed. Compared with fuel injection valves which have a conical valve seat with a conventional opening angle of about 60°, the fuel injection valve proposed has the advantage that the stroke of the valve needle required to traverse the seat restriction region is smaller and, as a result, a rapid succession of injections at a high injection pressure is possible. Moreover, the larger opening angle of the valve seat is supposed to reduce flow-induced disturbing forces on the valve needle, which can cause axial misalignment of the valve needle.

Given the constant increase in injection pressures, strength considerations, especially in the region of the valve seat, are nowadays to the fore in the development of modern fuel injection valves. In this context, the seat geometry chosen has a major influence on the operation of the fuel injector.

It is therefore the object of the present invention to provide a fuel injector which has a high strength, especially in the region of the valve seat.

SUMMARY OF THE INVENTION

The fuel injection valve proposed in order to achieve the object has a nozzle needle which is guided, such that it can perform a stroke motion, in a central bore of a nozzle body in order to open or close at least one injection opening, wherein the nozzle needle interacts, by means of an encircling sealing region formed on the combustion-chamber end thereof, with a conically extending sealing seat, which is formed on the combustion-chamber end of the nozzle body. According to the invention, the conically extending sealing seat has an opening angle $\alpha_1$ of between 40° and 50°. The advantage of such a seat geometry is that significant stress reductions can be achieved in the region of the sealing seat at the combustion-chamber end of the nozzle body owing to the smaller opening angle, which is well below the customary 60°. Owing to the stress reduction achieved or the lower loads imposed, it is possible, for example, to increase the injection pressure by corresponding values. As an alternative or as a supplementary measure, it is also possible for the nozzle body to have a smaller wall thickness in the region of the injection openings, with the result that the injection openings have a shorter length, and this, in turn, has a favorable effect on susceptibility to coking. Although it is also possible to achieve a higher strength or greater robustness of the sealing seat region by taking other strength-increasing measures, such as a higher grade of material, thicker walls or reinforcements, these measures are generally more costly and, as a rule, do not fail to affect the operation of the fuel injector.

Since there is the risk of axial misalignment of the nozzle needle, provision is furthermore made to form a guiding region, close to the seat, in the central bore for guiding the nozzle needle. The term "close to the seat" is used in the present case to refer to a guiding region which is formed within a region of the central bore, the length of which is no more than 40% of the total length of the nozzle body, starting from the combustion-chamber end of the nozzle body. By means of guidance close to the seat, axial misalignment or skewing of the nozzle needle can be counteracted.

Good jet symmetry and hence uniform distribution of the injected fuel in the combustion chamber of the internal combustion engine is thus ensured, something that would otherwise not be assured, especially in the case of valve-covered orifice nozzles, owing to the possible axial misalignment of the nozzle needle. For this purpose, the central bore has a region of reduced diameter for the formation of the guiding region close to the seat.

The seat geometry proposed entails a larger nozzle needle stroke to eliminate the restriction at the seat. Accordingly, quick-acting valves are preferably used in the fuel injection valve proposed. These make it possible for the stroke region above the seat restriction to be reached more quickly, thus ensuring that the full injection pressure is available at the injection openings within a short time. In order to increase the rapidity of the nozzle needle, a large ratio of the discharge to the feed restrictor can be chosen, for example. Thus larger needle strokes are compensated for by a "quick" needle. On the other hand, small and very small injection quantities can be metered more accurately through deliberate exploitation of the nozzle restriction region and of a reduced needle force in the case of small needle strokes. This is because a fuel injection valve according to the invention has a smaller needle force in the case of small needle strokes compared with fuel injection valves that have a 60° valve seat opening angle. This furthermore has the effect that when a servo valve is used for control of the nozzle needle, the control space is relieved more quickly, with the result, in turn, that the nozzle needle undergoes an acceleration.

According to a preferred embodiment, the at least one injection opening opens into the central bore of the nozzle body in the region of the sealing seat. Accordingly, the fuel injection valve preferably has what is referred to as a valve-covered orifice nozzle. Compared with blind-hole nozzles, in which the injection openings open into a blind hole below the sealing seat, valve-covered orifice nozzles have the advantage inter alia that the dead volume can be reduced by up to 50%. Owing to the smaller dead volume, hydrocarbon emissions are also significantly reduced. Since requirements as regards emissions are also constantly rising, reducing these emissions can be seen as a further object of the present invention. Thus, the proposed seat geometry for a fuel injection valve according to the invention, combined with design as a valve-covered orifice nozzle, proves particularly advantageous. Owing to the injection openings formed in the seat region, a valve-covered orifice nozzle does generally have a lower strength than a blind-hole nozzle but this is compensated for by the fact that it is possible to significantly reduce stresses through the proposed smaller opening angle of the sealing seat.

The guiding region close to the seat is preferably formed immediately adjacent to the sealing seat. On the one hand, this makes it possible to achieve optimum guidance of the nozzle needle and, on the other hand, the production of the guiding region within the central bore is simplified. The central bore has a reduced diameter to form the guiding region, and hence a region of the central bore with a larger diameter adjoins just one end of the guiding region, namely the end remote from the seat, making it possible to produce this enlarged diameter in a simple manner by opening it up.

The encircling sealing region formed on the nozzle needle preferably has at least one conical partial region. The cone angle $\alpha_2$ of this partial region is preferably at least slightly larger than the opening angle $\alpha_1$ of the sealing seat. The nozzle needle thus essentially rests against the sealing seat with a linear sealing contour. To form a sealing edge, the encircling sealing region can also be composed of two conical partial regions with different cone angles.

According to a preferred embodiment, the encircling sealing region formed on the nozzle needle has a pressure step with hydraulic effective surfaces which can be subjected to fuel pressure in an axial and/or a radial direction. Such a pressure step can also take the form of an encircling groove, for example. A hydraulic pressure applied thereto and acting in a radial direction can likewise contribute to guidance of the nozzle needle and thus prevent the risk of axial misalignment.

By virtue of the abovementioned characteristics, a fuel injection valve according to the invention is suitable particularly for modern combustion methods involving a high proportion of premixed combustion in the part-load range, which produce significantly increased hydrocarbon emissions. The nozzle designs which are usually chosen contribute to the increased emissions. This is because the injection nozzle is generally designed as a blind-hole nozzle with a seat cone angle of about 60°. In contrast, the nozzle design proposed here is capable of significantly reducing hydrocarbon emissions, of ensuring good spray symmetry and of achieving a strength in the nozzle region which allows high injection pressures. Moreover, the ballistic fuel injection valves without a stroke stop are widely used. A fuel injection valve according to the invention can also be designed in this way.

BRIEF DESCRIPTION OF THE DRAWINGS

The invention is explained in greater detail below with reference to the figures, of which.

DETAILED DESCRIPTION

Figure 1B:
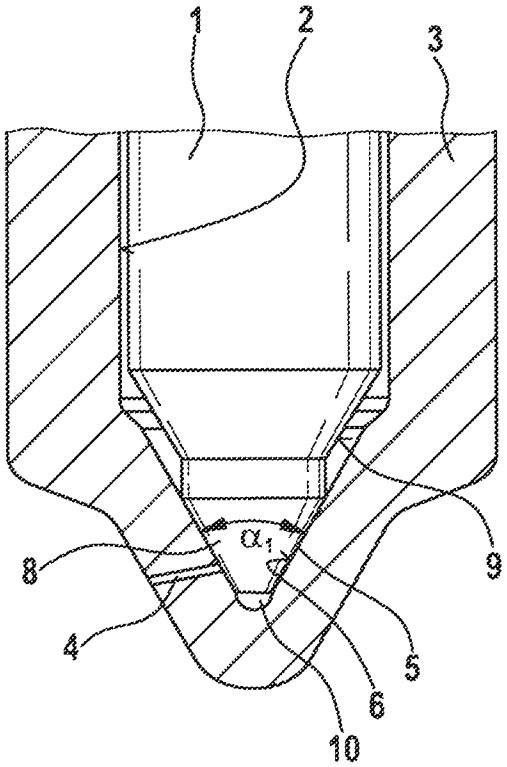
Fig. 1b (Prior Art)
FIGS. 1*a* and 1*b* show schematic partial sections in the region of the sealing seat, contrasting a 45° nozzle according to the invention with a known 60° nozzle.
Figure 1A:
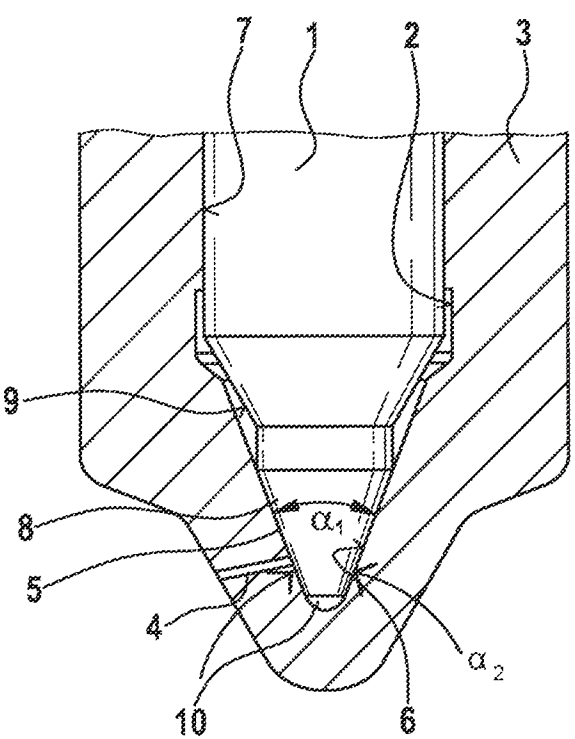

Of the comparative views in FIGS. 1*a* and 1*b*, that on the left (FIG. 1*a*) shows a nozzle design according to the invention and that on the right (FIG. 1*b*) shows a known nozzle design. Both nozzle designs comprise a nozzle needle 1 which is guided, such that it can perform a stroke motion, in a central bore 2 of a nozzle body 3. For this purpose, the nozzle design according to the invention has a guiding region 7 of reduced diameter close to the seat. The stroke motion of the nozzle needle 1 is used to open or close at least one injection opening 4. Both nozzles are designed as valve-covered orifice nozzles, that is to say the at least one injection opening 4 in each case opens into the central bore 2 in the region of a sealing seat 6 formed within the central bore 2. In each case, the sealing seat 6 has a conical shape which corresponds substantially to a conically extending partial region 8 of the nozzle needle 1 and forms a sealing region 5. Adjoining the conical partial region 8 of the nozzle needle 1 is a cylindrical partial region, followed in turn by a conical partial region, thus forming a pressure step 9 on the nozzle needle 1 and an annular space as a pressure chamber between the nozzle needle 1 and the sealing seat 6, this space being filled with fuel at high pressure during the operation of the injection valve. The pressure chamber is connected to an annular gap formed between the nozzle needle 1 and the central bore 2, said gap likewise serving as a pressure space. At the combustion-chamber end (at the bottom in FIG. 1), the central bore 2 in each case ends in a blind hole 10. The only differences are essentially those in respect of the chosen opening angle $\alpha_1$ of the conically extending sealing seat 6, which is 45° in the left-hand image (FIG. 1*a*) and 60° in the right-hand image (FIG. 1*b*), and the cone angle $\alpha_2$ of the conical partial region 8 of the nozzle needle 1, which is of corresponding configuration in each case.

Figure 2B:
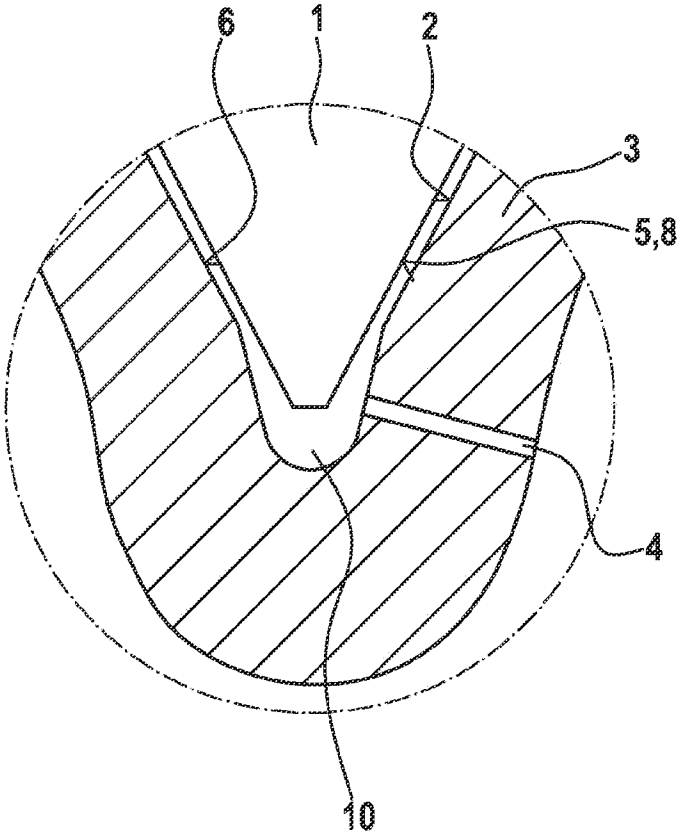
FIGS. 2*a* and 2*b* show schematic partial sections, contrasting a valve-covered orifice nozzle with a blind-hole nozzle.
Figure 2A:
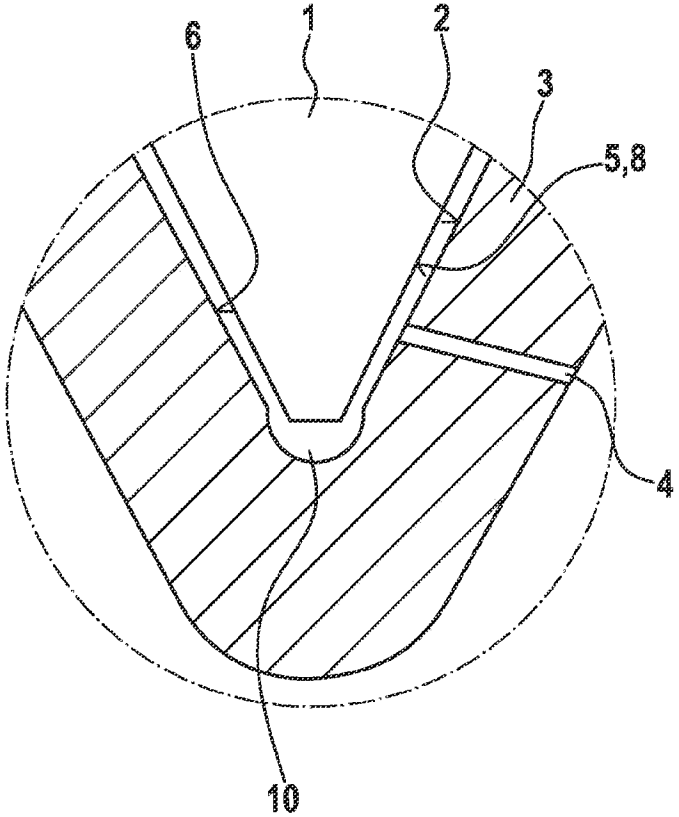

FIG. 2*a* shows a valve-covered orifice nozzle and FIG. 2*b* shows a blind-hole nozzle in comparison. In the case of the valve-covered orifice nozzle, the at least one injection opening 4 opens into the central bore 2 of the nozzle body in the region of the sealing seat 6, while, in the case of the blind-hole nozzle, the at least one injection opening 4 opens into the blind hole 10. In the case of the valve-covered orifice nozzle too, a dead volume remains in the blind hole 10 when fuel is injected into the combustion chamber of an internal combustion engine. As can be seen from the views in FIG. 2, however, this is significantly reduced, i.e. by about 50%. When using a valve-covered orifice nozzle, it is thus likewise possible significantly to reduce hydrocarbon emissions, and this is a further advantage.

The invention claimed is:

1. A fuel injection valve for injecting fuel into a combustion chamber of an internal combustion engine, the valve comprising:

a nozzle needle configured to perform a stroke motion in a central bore of a nozzle body in order to open or close at least one injection opening (4);

a sealing region encircling a portion of the nozzle needle, wherein the nozzle needle interacts with a conically extending sealing seat formed on the nozzle body, wherein the conically extending sealing seat has an opening angle ($\alpha_1$) of between 40° and 50°, and further wherein the at least one injection opening opens into the central bore in the region of the conically extending sealing seat, wherein the nozzle body comprises a guiding region as part of a central bore, the guiding region configured to facilitate axial alignment of the nozzle needle, and wherein the guiding region defines a first portion with a first diameter and a second portion with a second diameter greater than the first diameter, the second portion formed immediately adjacent to the conically extending sealing seat, wherein the guiding region length is no more than 40% of the total length of the nozzle body defined from an end adjacent the combustion chamber, and wherein the nozzle needle has a diameter that is complimentary to the first diameter of the guiding region.

2. The fuel injection valve as claimed in claim 1, wherein a cone angle ($\alpha_2$) of a conical portion of the nozzle needle is greater than the opening angle ($\alpha_1$) of the sealing seat.

3. The fuel injection valve as claimed in claim 1, wherein the encircling sealing region formed on the nozzle needle has a pressure step with hydraulic effective surfaces which can configured to be subjected to fuel pressure in an axial and/or a radial direction.

* * * * *